United States Patent [19]

Frater

[11] 4,368,773

[45] Jan. 18, 1983

[54] BOILER FEED PUMP TURBINE CONTROL SYSTEM

[75] Inventor: Robert L. Frater, Aston, Pa.

[73] Assignee: Westinghouse Electric Corp., Pittsburgh, Pa.

[21] Appl. No.: 142,195

[22] Filed: Apr. 21, 1980

[51] Int. Cl.[3] ..... F22D 5/32

[52] U.S. Cl. ..... 60/667; 60/665

[58] Field of Search ..... 60/656, 646, 657, 665, 60/667, 660; 122/406 ST

[56] References Cited

U.S. PATENT DOCUMENTS

| | | | |
|---|---|---|---|
| 3,818,699 | 6/1974 | Pritchard | 60/665 |
| 4,087,860 | 5/1978 | Beatty et al. | 60/656 X |
| 4,173,124 | 11/1979 | Fujii et al. | 60/667 |

*Primary Examiner*—Allen M. Ostrager
*Assistant Examiner*—Stephen F. Husar
*Attorney, Agent, or Firm*—D. Schron

[57] ABSTRACT

A boiler feed pump turbine system wherein the feed pump turbine speed is controlled by a signal locally generated by an operator up to a certain minimum speed and thereafter by a signal automatically commanded by a boiler feedwater control system. During operation within a certain speed range in which the signal from the boiler feedwater control system is controlling, a locally generated signal in the feedpump turbine control signal is caused to track the boiler control system signal so that in the event of failure thereof, the feed pump turbine may be controlled by the locally generated signal as opposed to reducing its speed to zero as would normally be dictated by the failed signal.

8 Claims, 2 Drawing Figures

BOILER FEED PUMP TURBINE CONTROL SYSTEM

BACKGROUND OF THE INVENTION

1. Field of the Invention

This invention in general relates to a boiler feed pump turbine system, and more particularly to an arrangement for protecting against a loss of signal.

2. Description of the Prior Art

In a steam turbine-generator system, the turbine is supplied with steam from a boiler (which may also be a nuclear steam generator) in accordance with operational needs of the system. In order to supply the boiler with feedwater there is provided a boiler feedwater supply system which includes a boiler feed pump driven by a turbine whose operation is controlled by a boiler feed pump turbine control system. Normally, the boiler feedwater pump requirements are coordinated with the speed and load demands of the main steam turbine-generator system so that in addition to the feed pump turbine control, there is also provided an overall boiler feedwater control system.

In an initial startup mode, the feed pump turbine is brought up to a desired speed by means of an operator using increase and decrease pushbuttons on an operator's panel to adjust a motor driven potentiometer, the output voltage of which is representative of a desired speed reference setpoint. This desired speed is compared with the actual speed of the feed pump turbine and any difference, or error, causes certain steam admission valves to the feed pump turbine to be controlled accordingly. At a certain predetermined minimum speed, control is transferred to the boiler feedwater control system which supplies an analog signal indicative of a certain desired speed of rotation of the turbine (and accordingly of the feed pump).

Typically, below a certain minimum speed, the lower valued one of the signals from either the boiler feedwater control system or the boiler feed pump turbine control system is utilized for comparison with the actual speed signal. As the apparatus reaches the normal operating speed range, the boiler feedwater control system signal takes command and the motor driven potentiometer is caused to provide a maximum output signal so as not to interfere with proper operation. A problem may arise, however, if the boiler feedwater control system signal fails, this condition will be sensed as calling for a minimum speed. Thus, the speed of the feed pump turbine will reduce to a minimum value inconsistent with the actual amount of feedwater flow that is required.

The present invention obviates this objectionable and possibly detrimental mode of operation upon a signal failure.

SUMMARY OF THE INVENTION

In the present invention, as in the prior art systems, the boiler feed pump turbine control system includes a means for generating a speed setter signal for controlling the speed of the turbine below a certain value. After that value and within a certain speed range, the boiler feedwater control system provides a boiler control turbine speed signal and means are provided for maintaining the speed setter signal at a value substantially equal to the boiler control turbine speed signal during operation within the particular speed range. Means are further provided for operating the turbine in accordance with the speed setter signal in the event of a failure of the boiler control turbine speed signal.

DESCRIPTION OF THE PREFERRED EMBODIMENT

Figure 1:
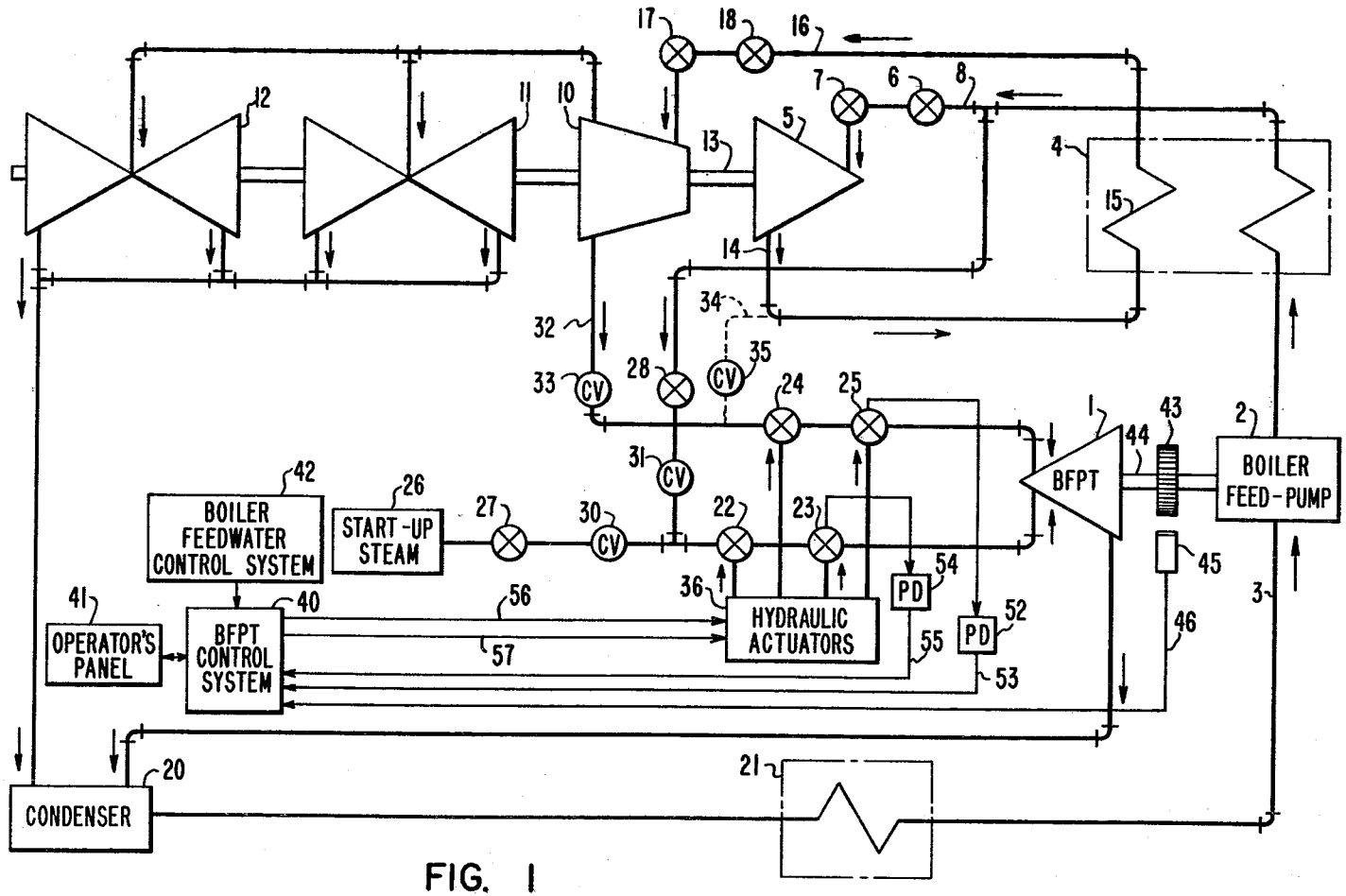
FIG. 1 is a block diagram of a typical steam supply system for a steam turbine.

In the arrangement of FIG. 1, a boiler feed pump turbine 1 is axially coupled to a boiler feed pump 2 for driving the boiler feed pump to pump water from a feedwater line 3 to a conventional steam boiler 4. The boiler 4 converts the feedwater into steam which is conducted therefrom to a high pressure turbine section 5. Normally, throttle and governor valves 6 and 7, respectively, are disposed in a steam line 8 between boiler 4 and high pressure turbine section 5 for the control of steam passing therethrough. Additional turbine sections such as an intermediate pressure turbine section 10 and one or more low pressure turbine sections 11 and 12 may be axially connected to the high pressure turbine section by means of a common shaft 13.

Steam exiting from the high pressure turbine section 5 is typically returned to the boiler 4 using the cross-under steam piping 14 for the purposes of reheating the steam in a reheater section 15 of boiler 4. The reheated steam is conducted to the inlet of the intermediate pressure turbine section 10 through the crossover piping 16. Interceptor valves 17 and reheat stop valves 18 may be used to shut off the steam from the reheater section 15 to the intermediate turbine section 10. Steam exiting from the intermediate pressure turbine section 10 usually enters the inputs to the one or more low turbine sections 11 and 12 and is exhausted therefrom to a condenser 20 to be reconverted into water. The condenser water is generally reheated with a plurality of feedwater heaters 21 and recycled to the boiler 4 at a rate determined by the boiler feed pump 2.

The rate of water pumped by feed pump 2 is normally a function of the rotational speed of the boiler feed pump turbine 1, this rotational speed being controlled by the amount of steam admitted thereto. High pressure steam supplied to the boiler feed pump turbine 1 is generally governed by a high pressure stop valve and high pressure governor valve 22 and 23 respectively. Low pressure steam admitted to the boiler feed pump turbine 1 is generally governed by a low pressure stop valve and low pressure governor valve 24 and 25, respectively.

High pressure steam admitted to the boiler feed pump turbine 1 may come from either the main steam header 8, which is the output of the boiler, or from one or more startup steam sources such as auxiliary boiler 26. Valves 27 and 28 may control the selection of the high pressure steam source to the boiler feed pump 1. Check valves 30 and 31 are included in the high pressure steam lines to the boiler feed pump turbine as an added precaution in isolating the two sources. The low pressure steam source is derived from an extraction line 32 from the intermediate pressure turbine 10 and a check valve 33 is included to prohibit any steam from backing into the intermediate pressure turbine 10. In those turbine systems which exclude the intermediate pressure turbine 10 an alternate source of low pressure steam may come from the exhaust line 14 of high pressure turbine 5, as shown by the dotted line 34. With this arrangement a check valve 35 is also included in line 34 to prohibit steam from backing into the steam exhaust line 14.

Hydraulic actuators 36 are used to position the steam control valves 22, 23, 24, and 25. The high pressure stop valve 22 and low pressure stop valve 24 are normally actuated in either an open or a closed state. High pressure governor valve 23 and low pressure governor valve 25 are modulated to govern the steam admission to the boiler feed pump turbine 1 so as to regulate the speed thereof. The governor valves, and consequently the speed of the feed pump turbine 1, are controlled by means of a boiler feed pump turbine control system 40 which may govern the turbine speed in accordance with either a speed setting adjusted from an operator's panel 41 or by means of a speed signal from a boiler feedwater control system 42.

For simplicity, the boiler feed pump turbine control system 40 will hereinafter be referred to as the turbine control system whereas the boiler feedwater control system will be referred to as the boiler control system. The turbine control system 40 is operable to generate a speed setter signal for the turbine and the boiler control system is operable to provide a boiler control signal, more particularly a boiler control turbine speed signal.

The rotating speed of the boiler feed pump turbine 1 is generally measured using a toothed wheel 43 coupled to the boiler feed pump shaft 44 and a magnetic speed pick-up 45 coupled adjacent to the toothed wheel produces a speed pulse with each passing occurrence of a tooth of the wheel 43. The speed pulses are transmitted to the turbine control system 40 over signal line 46. The speed measurement resulting from the speed pulses of signal path 46 may be used as an actual speed feedback signal to be subtracted from a commanded speed, the difference resulting in a speed correcting error signal used to control the positions of the high pressure governor valve 23 and low pressure governor valve 25. The actual position of valve 25 is detected by a position detector 52 generally of the linear variable differential transformer type and the measured position signal is transmitted back to the turbine control system 40 over signal line 53. Similarly, the position of valve 23 is monitored by a position detector 54 and a signal representative of the actual position is transmitted back to turbine control system 40 over signal line 55.

The measured position signal on line 53 is subtracted from a position setpoint generated within the turbine control system 40 to produce a position error for the low pressure governor valve 25. A low pressure governor valve position controller operates on this position error to produce a signal on signal line 56 to control the hydraulic actuator associated with the low pressure governor valve 25 to bring it to that commanded by the position setpoint. In addition, the measured position of the high pressure governor valve is also subtracted from the position setpoint to produce a position error which is operated on by another position controller to effect another hydraulic actuator control signal on line 57 to control the hydraulic actuator associated with the high pressure governor valve 23.

A typical operation of the boiler feed pump system may be initiated by opening valve 27 and closing valve 28 to allow startup steam to be conducted from startup steam source 26 through valve 27, check valve 30 to the high pressure stop valve 22. The high pressure stop valve may be fully opened through controls from the operator's panel 41. At this time, no water is being pumped into the boiler 4 and accordingly there is no steam being generated through the high pressure turbine section 5 or the intermediate pressure turbine section 10 so there is essentially no steam produced in lines 32 or 34. The boiler feed pump turbine 1 is operated initially by a turning gear starting motor at about 20 rpm rotational speed. The operator will normally set a nominal speed demand around 5 or 10% of rated speed and position the high pressure stop valve wide open. The speed error produced within the turbine control system 40 governs the positions of the low pressure governor valve 25 and high pressure governor valve 23 such as to permit steam admission to the boiler feed pump turbine 1 to increase the rotational speed thereof to a value set by the operator at the operator's panel 41. Since the low pressure governor valve 25 is ineffective because there is no existing low pressure steam, the low pressure governor valve 25 is controlled wide open and the high pressure governor valve 23 is controlled to a position to allow high pressure steam from the auxiliary source 26 to increase the rotational speed of the boiler feed pump turbine 1.

As the rotational speed of the boiler feed pump turbine 1 increases to 5 or 10% of rated speed, the boiler feed pump 2 will start pumping water at a rate controlled by the turbine 1. Boiler 4 will start converting the water to steam which will, under proper conditions, be admitted through the high pressure turbine section 5 and subsequently to the reheater 15 and intermediate pressure turbine section 10, and so on, through the low pressure turbine sections 11 and 12 through the condenser 20.

If the amount of low pressure steam increases, steam will be extracted from the intermediate pressure turbine section 10 to steam line 32, check valve 33, stop valve 24 to the low pressure governor valve 25. The contribution of this low pressure steam has the effect of increasing the speed of the boiler feed pump turbine 1 beyond that which is set by the speed setpoint. Speed error created as a result thereof causes the high pressure governor valve 23 to start to close to eliminate the contribution of high pressure steam coming from the start up auxiliary source 26. During this time the pressure at the throttle exit 8 of boiler 4 will be built up sufficiently for use as the high pressure steam source for the boiler feed pump turbine 1. When the low pressure steam source from steam line 32 is sufficient to individually control the rotational speed of the boiler feed pump turbine 1, the high pressure governor valve 23 will be essentially fully closed. At this time, the valve 27 may be fully closed and valve 28 fully open thus permitting high pressure steam to flow from the throttle header 8 instead of the auxiliary steam source 26.

Figure 2:
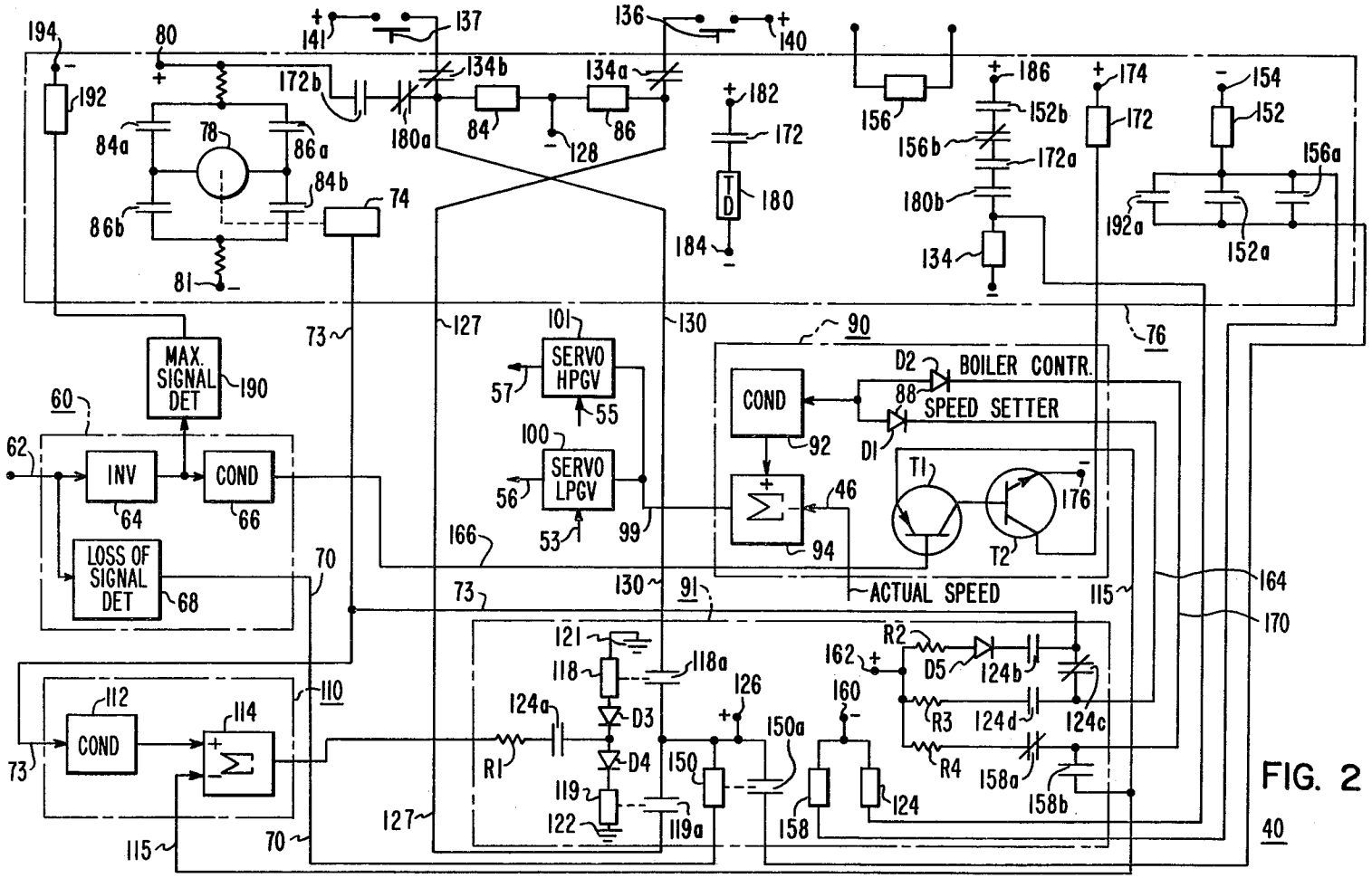
FIG. 2 is a block diagram of a boiler feed pump turbine control system in accordance with the present invention.

The rotational speed of the boiler feed pump turbine 1 may thereafter be controlled by the generation of a new speed setpoint through use of the operator's panel 41. The operator may control the rotational speed of the boiler feed pump turbine 1 until a certain minimum speed is obtained, and past which, operation is governed by a speed signal from boiler control system 42 which has been providing said signal during the startup operation but which signal has been ignored as long as the turbine speed was below the certain minimum operating speed. Past this minimum operating speed, and within a certain speed range, the rotational speed of the boiler feed pump turbine 1 is controlled by the boiler control system 42 in accordance with the operating requirements of the overall steam turbine-generator system. Should this speed signal from the boiler control system fail, it would be interpreted as calling for a minimum feed pump turbine speed which would reduce the feedwater flow to a dangerous minimum. The present invention obviates this possibility, and to this end, reference is made to FIG. 2 illustrating one embodiment of the present invention.

The turbine control system 40 of FIG. 2 includes an input section 60 for receiving, on line 62, the boiler control turbine speed signal, hereinafter called the boiler control signal. This input signal is inverted by means of inverter 64 whose output is provided to a conditioner circuit 66 to condition the signal to correspond to a particular operating speed range of a given system, for example, 3000 to 6000 rpm. The input section 60 additionally includes a loss of signal detector 68 operable to receive the input signal on line 62 and to provide on line 70 a indication of the presence or absence of the input signal.

The other signal which is utilized for turbine speed control is the speed setter signal on line 73, the speed setter signal being derived from a potentiometer 74 located on a main relay panel 76 and driven by a motor 78. This motor, connected between positive and negative terminals 80 and 81 has, in its energizing circuit, a plurality of contacts governed by relays 84 and 86. Thus, if relay 84 is energized, its corresponding contacts **84*a* and 84*b* in the motor circuit will close causing the motor to drive the potentiometer 74 to increase its output signal whereas if relay 86 is energized, its corresponding contacts 86*a* and 86*b* will close, reversing the motor and causing a decrease in the potentiometer output signal. The speed setter signal and boiler control signal are connected to gate circuit 88 of the signal select and speed control section 90**.

Gate 88 includes diodes D1 and D2 and, as will be demonstrated, diode D1 receives the speed setter signal and diode D2 receives the boiler control signal, both by way of a relay section 91. The gate is operable such that the lower valued signal applied to either diode D1 or D2, and only the lower valued signal, will be passed through to a conditioning circuit 92 where the amplitude of the signal may be changed to fit a specified speed range for the particular system controlled. The passed signal is then compared in summing circuit 94 with the feed pump turbine's actual speed signal on line 46. Any difference between the actual speed and the commanded speed (as evidenced by the passed one of the boiler control or speed setter signals) gives rise to a speed correcting error signal on line 99, which when provided to the low pressure governor value servo amplifier 100 and high pressure governor valve servo amplifier 101 will result in control signals being provided on line 56 or 57 to effect activation of the hydraulic actuators, as previously explained.

In the present invention, the speed of the feed pump turbine is governed by the speed setter signal for turbine speeds below a certain value, past which, speed control is governed by the boiler control signal. After transfer to the boiler control signal mode of operation, the speed setter signal is caused to track the boiler control signal so that in the event of a failure thereof, the speed setter signal will be at a value so as to prevent the feed pump turbine from experiencing a drastic and dangerous reduction in speed. This tracking function is accomplished with the provision of tracking section 110 which includes conditioning circuit 112 operable to receive the speed setter signal on line 73 to adjust its voltage so as to be compatible with the particular system parameters. Summing circuit 114 compares the speed setter signal from conditioning circuit 112, and a boiler control signal on line 115 to provide an output tracking error signal if the two are different. The boiler control signal on line 115 is derived from the emitter of transistor T1 of the signal select and speed control section 90. The base of transistor T1 is connected to receive the boiler control signal from conditioning circuit 66 and, as will be seen, the conduction of T1 is governed by the conduction of diode D2.

When the apparatus is in the automatic tracking mode the speed setter signal is varied so as to be made substantially equal to the boiler control signal. For this purpose the relay section 91 includes relays 118 and 119 with relay 118 being connected in the circuit between a ground terminal 121 and diode D3 whereas relay 119 is connected between ground terminal 122 and diode D4. The junction between diodes D3 and D4 is electrically connected to summing circuit 114 by way of resistor R1 and contact **124*a* of an automatic tracking relay 124**.

When relay 124 is activated for operation in the automatic tracking mode, its corresponding contact **124*a* will be closed and any error signal provided by summing circuit 114 will appear at the junction between diodes D3 and D4. If this error signal exceeds a certain positive value, relay 119 will be activated to close its associated contact 119*a*. The closing of this contact completes the circuit including positive terminal 126, contact 119*a*, line 127, relay 86 of relay panel 76, and negative terminal 128 thereby effectively placing relay 86 across the proper voltage for activation. This activation closes the associated contacts 86*a* and 86*b* of the motor circuit so as to cause rotation of the motor in a direction to lower the output voltage of potentiometer 74**.

If the error voltage provided by summing circuit 114 should decrease past some negative value, relay 118 will be activated closing its associated contact **118*a* and completing the circuit including positive terminal 126, contact 118*a*, line 130, relay 84 of relay panel 76, and negative terminal 128. The resultant activation of relay 84 causes its associated contacts 84*a* and 84*b* of the motor circuit to drive the motor in an opposite direction thereby increasing the output voltage of potentiometer 74**.

During this automatic tracking mode, contacts **134*a* and 134*b* of an automatic tracking relay 134 in the relay panel 76 will be in an open condition. When not in an automatic tracking mode, these contacts 134*a* and 134*b* will be in a closed condition communicative with respective pushbuttons 136 and 137 on the operator's panel. If pushbutton 136 is activated, it will place relay 86 between negative terminal 128 and positive terminal 140 to cause a decrease of the speed setter signal whereas activation of pushbutton 137 will place relay 84 between terminal 128 and terminal 141 to thereby cause an increase in speed setter signal. This operator selection of speed by dictating the speed setting signal, such as on initial startup, is unaffected by the previously described operation of relays 118 and 119, since these relays will be ineffective due to the fact that contact 124*a*** will be opened in this initial startup and non-automatic tracking mode.

Relay section 91 additionally includes a relay 150 operably connected to the loss of signal detector 68 of the input section 60. As long as there is a valid boiler control signal, relay 150 will be activated so as to close its associated contact 150*a*. The closing of contact 150*a* places relay 152 in the relay panel 76 across positive and negative voltage terminals 126 and 154 through a series of three parallel contacts.

Relay panel 76 includes a turbine trip relay 156 which is energized when the turbine is tripped such as upon initial startup. Its associated contact 156*a* therefore, upon startup, would be in a closed condition so that the closing of contact 150*a* in relay section 91 causes activation of relay 152. Since contact 156*a* will open when the turbine is not tripped, relay 152 is maintained in an activated condition by means of its associated contact 152*a*.

Another relay indicative of the presence of the boiler control signal is relay 158 of relay section 91. This relay is in parallel with relay 152 and when relay 152 is activated, relay 158 will be activated by virtue of its being placed across positive and negative terminals 126 and 160.

The automatic tracking relay 124 and loss of boiler control signal relay 158 of the relay section 91 include a plurality of associated contacts 124*b* through 124*d* and 158*a* and *b*, respectively. These contacts are connected in an arrangement which includes a plurality of resistors R2, R3 and R4 operatively connected to positive terminal 162. The path including resistor R2 includes a diode D5 and contact 124*b*. The path with resistor R3 includes contact 124*d* and the path with resistor R4 includes contact 158*a*. As long as there is a boiler control signal, relay 158 will be energized so that contact 158*a* will be opened and contact 158*b* will be closed. Upon initial startup, the apparatus is not in the automatic tracking mode and contacts 124*a* to 124*d* will be as illustrated.

During the initial startup period, the speed setter signal is provided to diode D1 of gate 88 by way of line 73, closed contact 124*c* and line 164. The voltage indicative of the boiler control signal is communicated to diode D2 of gate 88 by way of line 166, the base-emitter diode of transistor T1, line 115, closed contact 158*b*, and line 170. At this time, the speed setter signal is of a lower value than the boiler control signal and diode D1 will conduct to apply the speed setter signal to conditioning circuit 92. The voltage considerations are such that diode D2 is not conducting. Since no current is being passed through diode D2, transistor T1 operatively connected thereto will likewise not conduct current and transistor T2 will remain in an off condition.

When the value of speed setter signal increases to the value of the boiler control signal, there is a sharing of current through both diodes D1 and D2 until such point that the value of the speed setter signal is above the value of the boiler control signal such that diode D2 conducts to the exclusion of diode D1. When this occurs, the current flow allows transistor T1 to turn on, thereby turning on transistor T2 signifying a switch to the automatic mode of operation. The turning on of transistor T2 places relay 172, in the relay panel 76, across positive and negative terminals 174 and 176, thereby activating it. In response to the activation of the automatic mode relay 172, the speed setter signal will be increased for a predetermined period of time so as to positively insure for a lower valued boiler control signal at gate 88 and a smooth, or "bumpless", transition to the automatic mode. Thereafter, the speed setter signal is brought down to be substantially equal to, and track the boiler control signal while a dummy maximum signal will be applied to diode D1 of gate 88. As was stated, this operation was initiated by activation of relay 172.

Relay 172 operative controls three contacts: 172*a* located in a circuit of relay 134; contact 172*b*, located in the circuit of relay 84 between positive and negative terminals 80 and 128; and contact 172*c*, which, when closed by activation of relay 172, will place a time delay relay 180 across positive and negative terminals 182 and 184. Activation of its corresponding contacts 180*a* and 180*b* will be delayed for the predetermined time for which the speed setter signal is to increase. Thus when relay 172 is activated, relay 84 becomes activated in view of the completed path between positive terminal 80, closed contact 172*b*, closed contact 180*a*, relay 84 and negative terminal 128. After the aforementioned predetermined time period, relay 180 will cause the opening of contact 180*a* thereby disconnecting relay 84 and bringing a halt to the increase in speed setter signal.

When relay 134 is activated, operation will be in the automatic tracking mode. Examining relay 134, it is seen that it is positioned between positive and negative terminals 186 and 188 and includes a plurality of contacts in its energizing circuit. At this point contact 152*b* is closed since there is no loss of the boiler control signal. Contact 156S*b* is closed since the turbine is not tripped. Contact 172*a* is closed since operation is in the automatic mode. After the speed setter signal has been run up for the predetermined period of time, contact 180*b* will close thereby causing energization of the automatic tracking relay 134 which also has the effect of activating the automatic tracking relay 124 of relay section 91. When relay 134 activates, its contacts 134*a* and 134*b* open so that operator control from the operator's panel is prevented.

With the activation of the automatic tracking relay 124, its corresponding contact 124*a* will close thereby allowing operation of relays 118 and 119, as previously explained, to maintain the speed setter signal substantially equal to the boiler control signal. The closing of contact 124*b* places an equivalent load on the speed setter signal that it would normally see if it were being provided to diode D1 of gate 88, which it is not, since the connection to line 164 is broken by the open contact 124*c*. The closing of contact 124*d* places a high value signal on diode D1 so as to insure that only the lower valued boiler control signal will be passed through the gate. The situation at this time is such that a dummy signal is applied to diode D1 while the actual speed setter signal is tracking and is substantially equal to the boiler control signal.

Suppose now, by way of example, that the boiler control signal should fail. Rather than have the feed pump turbine speed go to zero to follow this command, the present invention detects this loss of signal and effectively substitutes the speed setter signal for turbine control.

With the loss of the boiler control signal, relay 150 drops out thereby opening contact 150*a* causing the other relays associated with the loss of boiler control signals, relays 152 and 158 to also deenergize. When relay 152 deenergizes, it in turn causes the energizing path for the automatic tracking relay 134 to open, thus additionally deenergizing the automatic tracking relay 124, bringing the apparatus out of the automatic tracking mode. Contacts 124*b*, 124*c* and 124*d* revert to the state illustrated such that the speed setter signal may be applied via line 164 to diode D1 of gate 88. With relay 158 deactivated, its corresponding contacts 158*a* and 158*b* revert to the condition illustrated such that the emitter of transistor T1 is thus effectively disconnected from line 170 and diode D2 of gate 88. In its place, a dummy signal is provided by virtue of resistor R4 and closed contact 158*a* so as to insure that the speed setter signal will be passed through gate 88. Speed control may thereafter be governed manually by operation of pushbuttons 136 and 137 as previously described.

After the defect has been remedied such that a valid boiler control signal is again available, it is temporarily adjusted to a high value so as to be above the value of the speed setter signal to insure for a "bumpless" transfer. The predetermined high value may be the maximum possible value of the boiler control signal which may be initiated by operator control of the boiler control system. In order to detect when this maximum signal is present on line 62, there is provided a maximum signal detector 190 connected to the output of inverter circuit 64 of input section 60. Upon attainment of the maximum signal value, it will cause the maximum signal relay 192 connected to terminal 194 to activate. Prior to this activation, relay 152 is prevented from activating since contact 152*a* is open as well as 156*a*. Activation of relay 192 closes its corresponding contact 192*a* thereby allowing activation of relay 152 and consequently, relay 158. Thereafter, the boiler control signal is reduced to its normally dictated level and the previously described procedures are carried out.

What is claimed is:

1. In a boiler feed pump turbine control system for controlling flow of feedwater pumped from a source to a boiler by a boiler feed pump driven by a turbine, by controlling the speed of said turbine in accordance with a turbine speed setter signal, for turbine speeds below a certain value, and in accordance with a boiler control turbine speed signal provided by a boiler feedwater control system, for turbine speeds above said value and within a certain speed range, and wherein the lower valued one of said signals is compared with an actual turbine speed signal to generate a speed correcting error signal, the improvement comprising:

(A) means for generating said speed setter signal;
(B) a tracking circuit;
(C) means for providing said speed setter and boiler control speed signals to said tracking circuit;
(D) said tracking circuit including means for comparing said speed setter and boiler control speed signals for generating a tracking error signal in accordance with the difference between them;
(E) tracking correction means responsive to said tracking error signal and operable to vary said speed setter signal to reduce said difference; and
(F) means for operating said turbine in accordance with said speed setter signal in the event of failure of said boiler control turbine speed signal.

2. Apparatus according to claim 1 which includes:

(A) a motor driven potentiometer;
(B) a motor coupled to drive said potentiometer;
(C) said motor having a first energizing circuit for operation in a first direction;
(D) said motor having a second energizing circuit for operation in a second direction;
(E) the output of said potentiometer constituting said speed setter signal;
(F) said tracking correction means being operable to activate said first energizing circuit of said motor if said difference between said signals exceeds a predetermined positive value; and
(G) said tracking correction means being operable to activate said second energizing circuit of said motor if said difference between said signals exceeds a predetermined negative value.

3. Apparatus according to claim 2 wherein:

(A) said first energizing circuit includes relay contacts for directing current through said motor in a first direction;
(B) said second energizing circuit includes relay contacts for directing current through said motor in an opposite direction;
(C) first and second relays for activating said respective relay contacts of said first and second energizing circuits;
(D) a third relay having associated contacts that when activated causes energization of said first relay to run said motor in a first direction;
(E) a fourth relay having associated contacts that when activated causes energization of said second relay to run said motor in an opposite direction;
(F) said third relay being activated in response to said difference between said signals exceeding said negative value; and
(G) said fourth relay being activated in response to said difference between said signals exceeding said positive value.

4. Apparatus according to claim 3 wherein:

(A) said third and fourth relays are disposed in a circuit between points of reference potential;
(B) said circuit including first and second serially arranged diodes located between said third and fourth relays; and
(C) means for applying said tracking error signal to the junction between said diodes.

5. Apparatus according to claim 1 which includes:

(A) means for increasing the value of said speed setter signal when control is transferred to said boiler control signal, for a predetermined period of time and for reducing the value of said speed setter signal to be substantially equal to said boiler control signal, after said predetermined period of time.

6. Apparatus according to claim 1 which includes:

(A) a gating circuit having first and second inputs for receipt of signals and operable to gate the lower valued applied signal;
(B) means for applying said speed setter signal to said first input;
(C) means for applying said boiler control signal to said second input;
(D) means for applying a maximum valued signal to said first input during control by said boiler control signal; and
(E) means for applying a maximum valued signal to said second input in the event of failure of said boiler control signal.

7. Apparatus according to claim 6 which includes:

(A) a dummy load; and
(B) means for applying said speed setter signal to said dummy load during control by said boiler control signal.

8. Apparatus according to claim 1 wherein:

(A) said boiler control signal is initially set to a maximum value after correction of a failure; and which includes
(B) means for preventing operation of said tracking correction means unless said boiler control signal has been initially set at said maximum.

* * * * *